US012781426B2

(12) United States Patent
Cheng

(10) Patent No.: US 12,781,426 B2
(45) Date of Patent: Nov. 3, 2026

(54) ELASTIC NON-WOVEN FABRIC WITH ELASTICITY IN WARP DIRECTION AND MANUFACTURING METHOD THEREOF

(71) Applicant: GOLDEN PHOENIX FIBERWEBS, INC., Tainan City (TW)

(72) Inventor: Kenneth Cheng, Taipei City (TW)

(73) Assignee: GOLDEN PHOENIX FIBERWEBS, INC., Tainan City (TW)

( * ) Notice: Subject to any disclaimer, the term of this patent is extended or adjusted under 35 U.S.C. 154(b) by 212 days.

(21) Appl. No.: 18/746,777

(22) Filed: Jun. 18, 2024

(65) Prior Publication Data

US 2025/0327238 A1 Oct. 23, 2025

(30) Foreign Application Priority Data

Apr. 19, 2024 (TW) ..... 113114651

(51) Int. Cl.

| | |
|---|---|
| ***D06J 1/10*** | (2006.01) |
| ***D04H 1/492*** | (2012.01) |
| ***D04H 1/558*** | (2012.01) |
| ***D06C 15/02*** | (2006.01) |
| ***D06C 15/08*** | (2006.01) |
| ***D06C 27/00*** | (2006.01) |

(52) U.S. Cl.

CPC ..... *D06J 1/10* (2013.01); *D04H 1/558* (2013.01); *D06C 15/02* (2013.01); *D06C 15/08* (2013.01); *D06C 27/00* (2013.01); *D10B 2401/061* (2013.01)

(58) Field of Classification Search

CPC ..... D04H 1/492; D04H 1/558; D04H 1/46; D04H 1/56; D06C 27/00; D06C 15/08; D06C 15/02; D06C 3/02; D06C 3/021; D06C 3/025; D06J 1/10; D10B 2401/061

See application file for complete search history.

(56) References Cited

U.S. PATENT DOCUMENTS 492,116 A * 2/1893 Smith ..... D06J 1/10 271/30.1
1,906,510 A * 5/1933 Balduf ..... B29C 53/043 156/461

(Continued)

FOREIGN PATENT DOCUMENTS

GB 792355 A * 3/1958 ..... D06C 3/028
GB 971430 A * 9/1964 ..... D06C 23/00

*Primary Examiner* — Emmanuel S Luk
(74) *Attorney, Agent, or Firm* — RABIN & BERDO, P.C.

(57) ABSTRACT

An elastic non-woven fabric with elasticity in warp direction and a manufacturing method thereof are provided, including: a feeding step, feeding a non-woven fabric into a location between the differential gears and suction gears in an overfeeding manner; a wave forming step, entering the non-woven fabric to a location between the differential gears and the suction gears, thereby forming wavy folds; a fixing step, providing a suction force through suction holes of the suction gears to make the non-woven fabric closely fit outer surfaces of the suction gears, and fix the wavy folds; a press-flattening step, press-flattening the wavy folds; a pre-heating step, heating the non-woven fabric to soften it; a broadening step, stretching the non-woven fabric in a weft direction and making it be oriented, and straightening the wavy folds at the same time; a stabilizing step; and a cooling step, cooling the non-woven fabric to set it.

8 Claims, 13 Drawing Sheets

(56) References Cited

U.S. PATENT DOCUMENTS

| | | | | | |
|---|---|---|---|---|---|
| 2,434,111 | A * | 1/1948 | Hawley, Jr. | D03D 15/56 | 26/96 |
| 2,786,616 | A * | 3/1957 | Cady | D06J 1/10 | 38/144 |
| 2,961,735 | A * | 11/1960 | Mohring | B29C 53/285 | 26/86 |
| 3,469,291 | A * | 9/1969 | Fritz | D06C 3/025 | 26/93 |
| 3,511,424 | A * | 5/1970 | Tucci | D06J 1/10 | 223/34 |
| 4,232,434 | A * | 11/1980 | Pfister | D06C 3/10 | 26/86 |
| 4,890,365 | A * | 1/1990 | Langer | B29C 55/165 | 26/73 |
| 5,014,402 | A * | 5/1991 | Cunningham | B29C 55/08 | 26/93 |
| 5,042,121 | A * | 8/1991 | Young, Jr. | D06C 3/065 | 26/96 |
| 5,255,419 | A * | 10/1993 | Stanislaw | D06C 3/02 | 26/84 |
| 6,371,749 | B2 * | 4/2002 | Thompson | D04H 3/03 | 156/181 |
| 7,322,312 | B1 * | 1/2008 | Stoehrmann | D06C 3/02 | 118/325 |
| 9,144,935 | B2 * | 9/2015 | Maki | B29C 55/18 | |
| 2009/0209156 | A1 * | 8/2009 | Pedoja | D04H 1/495 | 264/293 |
| 2009/0260747 | A1 * | 10/2009 | Davis | D06C 3/021 | 156/181 |
| 2024/0075704 | A1 * | 3/2024 | Cheng | B32B 5/022 | |

* cited by examiner

ELASTIC NON-WOVEN FABRIC WITH ELASTICITY IN WARP DIRECTION AND MANUFACTURING METHOD THEREOF

BACKGROUND OF THE INVENTION

1. Field of the Invention

The present invention relates to an elastic non-woven fabric with elasticity in warp direction and a manufacturing method thereof, specially an elastic non-woven fabric with elasticity in warp direction in which wavy folds are firstly formed, and the orientation of fibers of the non-woven fabric are changed and the non-woven fabric is imparted with elasticity through heat softening, stretching in weft direction, and cooling and setting, and then the wavy folds are straightened, and a manufacturing method thereof.

2. The Prior Arts

General sanitary products, such as masks, disposable clothing, infant diapers or adult diapers, or sport protective bandages, medical bandages, etc., are usually provided in disposable forms when considering hygiene and using safety to avoid contamination of germs or harmful substances. Because such products will be in contact with the skin for a period of time, there are stricter requirements on breathability to prevent discomfort, skin allergies, itching, and even rashes caused by hot or humid conditions.

Since non-woven fabrics made of plastic materials have the advantages of easy manufacturing, processing, good chemical resistance, durability and low cost, they have been widely used in many sanitary products. However, non-woven fabrics have poor extensibility, insufficient comfort and cladding properties, which may cause inconvenience in wearable applications such as diapers. Therefore, composite non-woven fabrics with improved extensibility have been developed in the industry, which can be referred as to elastic composite non-woven fabrics.

In an existing manufacturing process of elastic composite non-woven fabrics, a common method is to pre-stretch a piece of elastic material as a middle layer, and then use two pieces of general non-woven fabrics without elasticity as upper and lower layers, respectively, perform bonding in a sandwich manner, and stop applying external force for stretching after bonding to form wavy folds on upper and lower surfaces of the elastic composite non-woven fabric; the other common method is to use a piece of elastic material as a middle layer without stretching, and then use two pieces of general non-woven fabrics without elasticity as upper and lower layers, respectively, perform bonding in a sandwich manner to form a three-layer structure in a flat shape, after bonding, the material surface of the general non-woven fabric is damaged, such as activated, to make the general non-woven fabric slightly extensible.

However, in addition that there are more manufacturing steps, the bonding also makes the non-woven product thicker, causing poor comfort to user, and increasing the space and cost required for storage and transportation. Also, peeling phenomenon of the product may be occurred due to incomplete bonding. Moreover, if the bonding is performed by an adhesive, the peeling phenomenon may easily occur due to non-uniform distribution of the adhesive.

Another existing technique is to use elastomers as raw materials to manufacture a single-layered elastic non-woven fabric through processes for non-woven fabric such as melt-blowing or spun-bonding, however, the cost thereof is high. Therefore, an object of the present invention is to develop an elastic non-woven fabric, which imparts elasticity to a single-layered non-woven fabric only by the thermoplastic property of synthesized fibers, thereby having the advantage of significantly reduced costs.

Among the existing non-woven fabric manufacturing process, in addition to spun-bonding process, there are also other processes such as spunlace, needle-punching, and melt-blowing. The spun-bonding process refers a method in which raw materials are melted through an extrusion equipment and extruded from a nozzle, stretched and cooled via an air duct to form ultra-fine fibers, and then blown toward a collecting net and accumulate into a network structure, and the long fibers with a disordered network structure pass through a heated hot roller, thereby performing hot-pressing and bonding for the fiber layer.

Due to the thermoplastic property of the plastic non-woven fabrics (soft when being heated and hard after being cooled) and a non-oriented distribution property of the fiber tissue of general non-woven fabrics (as shown in FIG. 1A, the fiber tissue 11 of the non-woven fabric is randomly oriented), hot airflow can be used to penetrate the fiber tissue to heat the fibers to the corresponding softening temperature, and while heating and softening, the distributed fibers are mechanically stretched continuously in the weft direction to change the orientation of the fiber tissue (the non-woven fabric in FIG. 1A is stretched in the weft direction such that the fiber tissue 11 is oriented in the weft direction to a status shown in FIG. 1B, while the non-woven fabric is necked in the warp direction).

Since the orientation of the fibers in the fiber tissue 11 of the non-woven fabric contributes to providing elasticity, after the elastic non-woven fabric that has been softened by heating and stretched in the weft direction is cooled, its fiber tissue forms a state of a telescopic robotic arm as shown in FIG. 1B, wherein when a stretching force in the warp direction is applied, the fiber tissue 11 oriented in the weft direction of the non-woven fabric (as shown in FIG. 1B) can be stretched along the warp direction back to a state where the fiber orientation has not been altered (as shown in FIG. 1A), thereby providing extensibility in the warp direction; moreover, after stop applying the stretching force in the warp direction, the fiber tissue 11 of the elastic non-woven fabric will restore to the state being oriented in the weft direction (as shown in FIG. 1B), thereby providing a restoring ability in the warp direction; that is, such elastic non-woven fabric has a stretching and restoring ability in the warp direction.

On the other hand, FIG. 2A and FIG. 2B respectively show the microscopic images of general spunlace non-woven fabric before and after being stretched in the weft direction, in which it can be also observed that the fiber tissue of the non-woven fabric is oriented in the weft direction after being stretched.

In addition, a necking deformation of the non-woven fabrics will occur (see the necking area N in FIG. 3) after mechanical stretching in the weft direction, and the area in the warp direction of the non-woven fabric material will be reduced due to the Poisson's ratio. Therefore, by overfeeding the non-woven fabric along the warp direction in advance (that is, the fabric feeding speed is greater than the running speed of the needle clips), the non-woven fabric can form a wavy state, so as to reduce the tension in the warp direction of the fabric, thereby compensating the necking phenomenon mentioned above, and preventing the non-woven fabric from becoming too thin due to the necking phenomenon after stretching, which facilitates the broadening in the weft direction.

However, conventional overfeeding simply based on speed difference will cause uneven wavy folds of the non-woven fabrics, which will lead to a problem of uneven fabric surface after broadening in the weft direction. Therefore, there is a need for an improved manufacturing method of an elastic non-woven fabric.

SUMMARY OF THE INVENTION

In view of the problems encountered in the prior art, the present invention is to provide a manufacturing method of an elastic non-woven fabric with elasticity in warp direction, in which by pre-forming regular wavy folds on a non-woven fabric and using an air suction device, the reduced area or reduced thickness of the non-woven fabric caused by necking during subsequent stretching can be compensated, thereby improving the unevenness by conventional overfeeding; and a single-layered elastic non-woven fabric manufactured according to the above method, which has strong resilience in the warp direction and has a flat surface. Therefore, it can be directly used in products without being bonded to another elastic base material, thereby greatly improving production rate, improving comfort to user, and reducing the space and cost required for storage and transportation.

In order to solve the above problems, the present invention provides a manufacturing method of an elastic non-woven fabric, sequentially comprising:

a feeding step, using at least two feeding wheel sets to feed a non-woven fabric, wherein the feeding wheel sets are respectively located at both sides in a weft direction of the non-woven fabric, and each feeding wheel set includes a differential gear and a suction gear that engage with each other, wherein each differential gear is provided with a plurality of first teeth portions and a plurality of first groove portions alternately arranged along an outer circumferential surface of the differential gear, and each suction gear is provided with a hollow groove at a center in the weft direction on an outer surface thereof, and each suction gear is provided with a plurality of second teeth portions, a plurality of second groove portions and a plurality of suction holes at both sides in the weft direction of the hollow groove, respectively, wherein the second groove portions and the second teeth portions are alternately arranged along both sides in the weft direction of an outer circumferential surface of the suction gears, respectively, and the suction holes are provided at least on the second groove portions, wherein the differential gears feed both sides in the weft direction of the non-woven fabric into a location between the differential gears and the suction gears respectively along a warp direction;

a wave forming step, rotating the differential gears and the suction gears with engaging with each other in a manner that the first teeth portions are inserted into the second groove portions and the second teeth portions are inserted into the first groove portions, such that both sides in the weft direction of the non-woven fabric respectively enter a location between the first teeth portions and the second groove portions and a location between the first groove portions and the second teeth portions, thereby forming regular wavy folds on the non-woven fabric along the warp direction;

a fixing step, using the suction gears and at least two pin chains in a form of conveyor belt to fix the wavy folds of the non-woven fabric, wherein the pin chains are respectively located on both sides in the weft direction of the non-woven fabric, and the feeding wheel sets are respectively arranged above the pin chains, and a plurality of pins are provided on each pin chain, wherein a suction force is provided through the suction holes to make both sides in the weft direction of the non-woven fabric closely fit outer surfaces of the second teeth portions and the second groove portions, respectively, and the pin chains run in the form of conveyor belt while the suction gears rotate, making the pins puncture the non-woven fabric and enter the hollow grooves, respectively, to fix the wavy folds of the non-woven fabric, and the suction gears stop providing the suction force after the pins puncture the non-woven fabric, such that the non-woven fabric can be smoothly transferred from the suction gears to the pin chains;

a press-flattening step, press-flattening the wavy folds of the non-woven fabric through at least two brush wheels, wherein the brush wheels are respectively disposed above the pin chains at downstream in the warp direction of the feeding wheel sets, and the brush wheels rotate while the pin chains run in the form of conveyor belt, so as to press-flatten the wavy folds of the non-woven fabric on the pin chains;

a preheating step, using the pin chains to transport the non-woven fabric along the warp direction with maintaining a fixed distance in the weft direction of the pin chains, meanwhile, using a heating device to heat the non-woven fabric to soften it;

a broadening step, under proceeding the heating of the heating device, using the pin chains to transport the non-woven fabric along the warp direction with the distance in the weft direction of the pin chains gradually increased to stretch the non-woven fabric in the weft direction, such that a necking compensation effect of the non-woven fabric occurs along the warp direction to straighten the wavy folds that extend along the warp direction and are press-flattened, thereby making a fiber tissue of the non-woven fabric be oriented along the weft direction, such that the non-woven fabric is in a flat shape and has a stretching and restoring ability along the warp direction;

a stabilizing step, under proceeding the heating of the heating device, using the pin chains to transport the non-woven fabric along the warp direction with maintaining the increased distance in the weft direction for stabilizing the non-woven fabric; and a cooling step, cooling the non-woven fabric to set it, thereby forming the elastic non-woven fabric with elasticity in the warp direction;

wherein in the feeding step, the differential gears feed the non-woven fabric into the location between the differential gears and the suction gears along the warp direction at a speed higher than a conveying speed of the pin chains.

In an embodiment of the present invention, the suction holes are further provided on the second teeth portions.

In an embodiment of the present invention, in the preheating step, the broadening step and the stabilizing step, the heating is performed at a heating temperature of 120 to 180° C., preferably 130 to 150° C.

In an embodiment of the present invention, in the broadening step, a broadening ratio of the non-woven fabric in the weft direction is between 15 and 100%.

In an embodiment of the present invention, in the fixing step, respective pins on the pin chains are aligned with a peak and/or a trough of the wavy folds, respectively.

In an embodiment of the present invention, a ratio of a spacing between the first teeth portions, a spacing between the second teeth portions, and a spacing between the pins is 1:1:1 or 1:1:0.5.

In an embodiment of the present invention, the non-woven fabric is made by spun-bonding, spunlace, thermal-bonding, melt-blowing, or needle-punching.

In an embodiment of the present invention, the non-woven fabric is made of a material selected from a group consisting of PP, PE, PET, PP/PE, PP/PET, or a combination thereof.

In order to solve the above problems, the present invention also provides an elastic non-woven fabric with elasticity in warp direction, wherein the elastic non-woven fabric with elasticity in warp direction has a flat surface and has a fiber tissue substantially oriented in the weft direction, such that the elastic non-woven fabric with elasticity in warp direction has a stretching and restoring ability along the warp direction.

In an embodiment of the present invention, the elastic non-woven fabric with elasticity in warp direction has an elongation in the warp direction between 50 and 350%.

The effects of the present invention are that: first, by feeding the non-woven fabric through the differential gears and the suction gears that engage with each other, regular wavy folds can be formed on the non-woven fabric, which is beneficial to ensure the surface flatness of the final elastic non-woven fabric; second, by providing a suction force through the suction gears to make the non-woven fabric closely fit outer surfaces of the teeth portions and groove portions of the suction gears, the non-woven fabric with the wavy folds can be transferred to the subsequent process with maintained shape, which is beneficial to improve the uniformity of the final fabric surface; third, by disposing a hollow groove at a center on the outer surfaces of the suction gears, a space for accommodating the pins on the pin chains after the pins puncture the non-woven fabric can be provided; fourth, by slightly stretching in the weft direction under heating to change the fiber orientation and subsequent cooling and setting, the non-woven fabric can have better elasticity in the 10 warp direction than the prior art; fifth, by pre-forming regular wavy folds, the reduced area or reduced thickness of the non-woven fabric caused by necking during subsequent stretching can be compensated; sixth, by making the single-layered non-woven fabric have excellent elasticity after processing, additional bonding materials or bonding steps can be omitted, thereby reducing the manufacturing costs and making the product thinner to improve comfort to user, and reducing the space and cost required for storage and transportation.

The effects of the present invention are not limited to the effects described above, and a person skilled in the art can clearly understand other effects not mentioned from the description of the claims.

DETAILED DESCRIPTION OF THE PREFERRED EMBODIMENT

The advantages and features and the implementing method thereof of the present invention will be more clearly understood from the embodiments described below with reference to the accompanying drawings. However, the present invention is not limited to the following embodiments, but may be implemented in various different forms.

The technical features of any aspect of the present invention can be combined with those of other aspects of the present invention without contradiction.

Herein, "MD (Machine direction)" refers to a direction parallel to the direction of the manufacturing equipment transporting the non-woven fabrics, also called as the warp direction; and "TD (Transverse direction)" refers to a direction vertical to the direction of the manufacturing equipment transporting the non-woven fabrics.

Herein, "Broaden ratio" refers to a ratio of the final stretching amount of a material (such as a raw material of non-woven fabric) relative to its original width to an original width of the material during a broadening stage.

Herein, "Elonation" refers to a ratio of a maximum elongation amount of a material (such as an elastic non-woven fabric with elasticity in warp direction) relative to its natural width to a natural width of the material.

Figure 3:
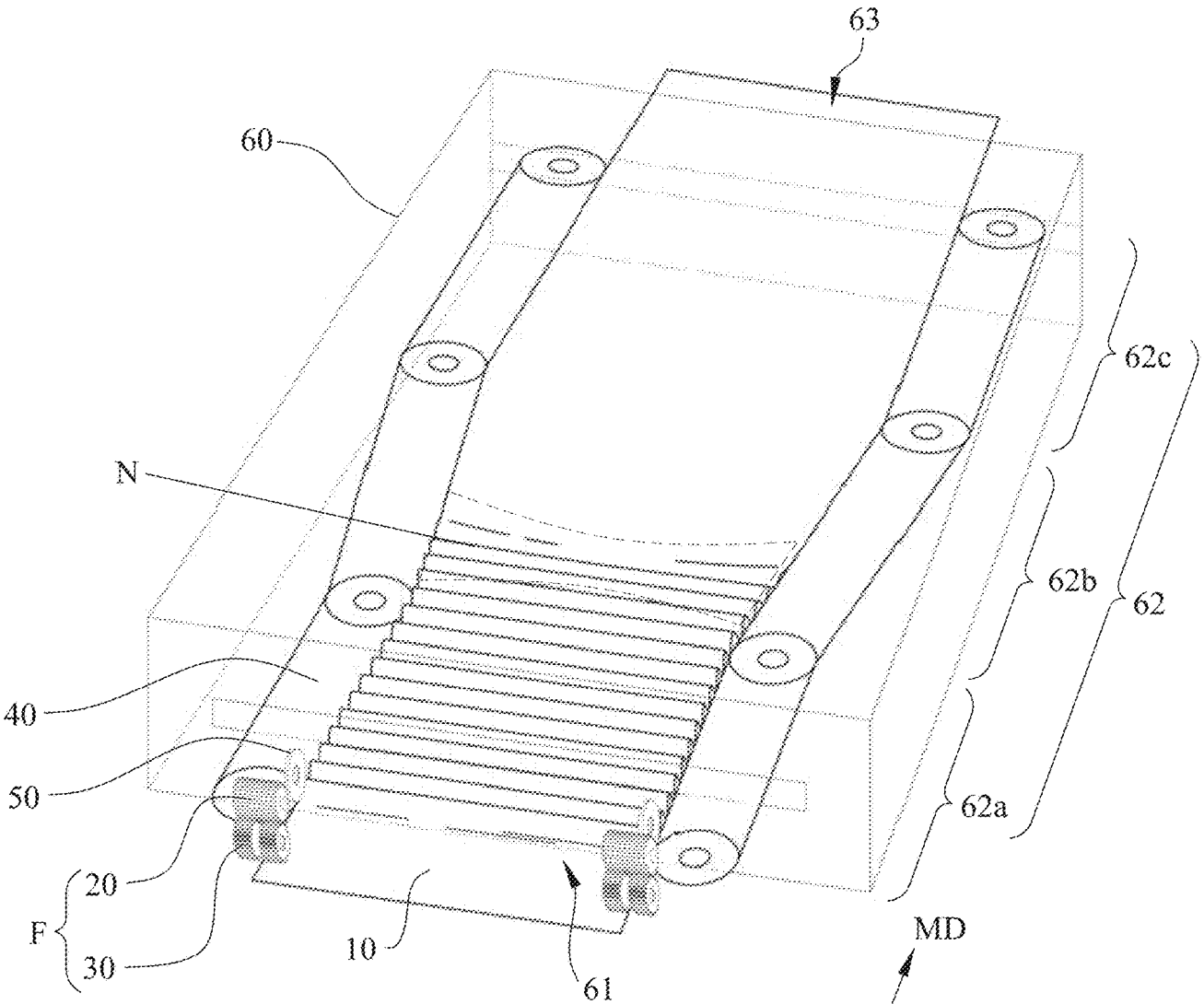
FIG. 3 shows a perspective view of a manufacturing equipment for an elastic non-woven fabric with elasticity in warp direction of the present invention.

Referring to FIG. 3, the present invention provides a manufacturing equipment of an elastic non-woven fabric with elasticity in warp direction, comprising: a heating device 60, a pin chain 40 in the form of conveyor belt, feeding wheel sets F, and a brush wheel 50.

The heating device 60 has an inlet 61, an internal space 62 and an outlet 63 in sequence along the warp direction, wherein the internal space 62 is divided into a preheating section 62*a* adjacent to the inlet 61, a broadening section 62*b* in the middle, and a stabilizing section 62*c* adjacent to the outlet 63 in the warp direction.

In the present invention, the non-woven fabric can be softened by heat for processing and shaping by the heating device 60, such as an oven, but not limited thereto. The internal space 62 of the heating device 60 is the space that is actually heated, and the inlet 61 and the outlet 63 of the heating device 60 can be designed to be heated or not heated depending on demand.

Since non-woven fabrics 10 with different components have different softening points, the heating temperature for the heating device 60 can be 120 to 180° C., preferably 130 to 150° C.

The number of the pin chains 40 is at least two, and the two are located at both sides of the heating device 60 in the weft direction, respectively, and extends from the inlet 61, through the preheating section 62*a*, the broadening section 62*b* and the stabilizing section 62*c*, to the outlet 63 of the heating device 60 in sequence along the warp direction. Each pin chain 40 is provided with a plurality of pins 41.

Referring to FIG. 3, the number of the feeding wheel sets F is at least two, and the two are respectively disposed above the pin chains 40 at both sides of the inlet 63 of the heating device 60.

Each feeding wheel set F includes differential gears 20 and suction gears 30 that engage with each other.

Each differential gear 20 is provided with a plurality of first teeth portions 21 and a plurality of first groove portions 22, which are alternately arranged along an outer circumferential surface of the differential gear 20.

Figure 4:
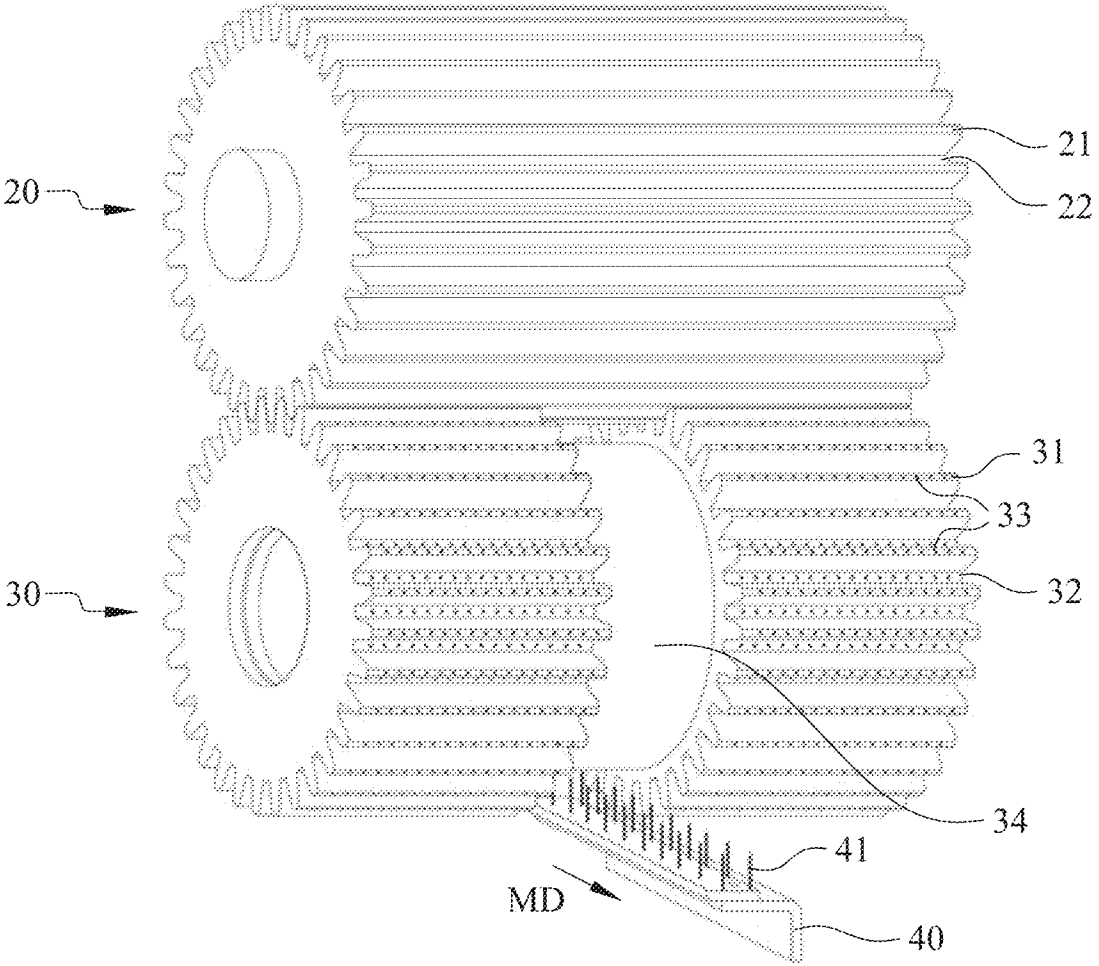
FIG. 4 shows a schematic diagram showing pins entering a hollow groove in the manufacturing equipment of the present invention, in which the non-woven fabric is not shown.

Referring to FIG. 4, each suction gear 30 is provided with a hollow groove 34 at a center in the weft direction on an outer surface thereof; and each suction gear 30 is provided with a plurality of second teeth portions 31, a plurality of second groove portions 32 and a plurality of suction holes 33 at both sides in the weft direction of the hollow groove 34, respectively, wherein the second groove portions 32 and the second teeth portions 31 are alternately arranged along both sides of the weft direction of the outer circumferential surface of the suction gears 30, respectively, and the suction holes 33 are provided at least on the second groove portions 32.

Referring to FIG. 3, the number of the brush wheels 50 is at least two, and the two are respectively disposed above each pin chain 40 at downstream in the warp direction of each feeding wheel set F.

In the manufacturing equipment of the present invention, the pin chains 40, the feeding wheel sets F, and the brush wheels 50 are preferably symmetrically arranged relative to each other at both sides in the weft direction of the heating device 60, which is beneficial to the smooth transportation of the non-woven fabric and avoids pulling and drag or unevenness of the non-woven fabric during the processing.

In addition, although in the specification, the configuration including two pin chains 40, two feeding wheel sets F, and two brush wheels 50 are taken as an example for describing, a person skilled in the art can understand that additional pin chain(s) 40, feeding wheel set(s) F and brush wheel(s) 50 can be appropriately added between the above components, depending on the trade-off between the equipment cost and the processing precision according to product requirements.

In the present invention, a general non-woven fabric 10 is processed by the manufacturing equipment of the elastic non-woven fabric with elasticity in warp direction, thereby the orientation of the fibers is changed after heat-softening, stretching in the weft direction, and cooling and setting, so as to be oriented in the weft direction, thereby imparting the non-woven fabric an elasticity in the warp direction.

Preferably, the non-woven fabric 10 includes, but is not limited to those made by spun-bonding, spunlace, thermal-bonding, melt-blowing or needle-punching.

In order to meet the heat-softening and cool-setting characteristics required in the manufacturing process, the non-woven fabric 10 used in the present invention is made of thermoplastic materials, such as polypropylene (PP), polyethylene (PE), polyethylene terephthalate (PET), two-component PP/PE, two-component PP/PET, or a combination thereof, but not limited thereto.

The operation manner of the manufacturing equipment of the elastic non-woven fabric with elasticity in warp direction of the present invention is explained below.

First, the differential gears 20 feeds both sides in the weft direction of the non-woven fabric 10 into each set of the differential gears 20 and the suction gears 30 along the warp direction respectively at a conveying speed higher than that of the pin chains 40 (that is, in an overfeeding manner), wherein each set of the differential gears 20 and the suction gears 30 engage and rotate with each other in a manner that the first teeth portions 21 are inserted into the second groove portions 32 and the second teeth portions 31 are inserted into the first groove portions 22, such that both sides in the weft direction of the non-woven fabric 10 respectively enter a location between the first teeth portions 21 and the second groove portions 32 and a location between the first groove portions 22 and the second teeth portions 32, thereby forming regular wavy folds on the non-woven fabric 10 along the warp direction.

Then, the suction gears 30 provides a suction force through the suction holes 33 at least disposed on the second groove portions 32, such that both sides in the weft direction of the fed non-woven fabric 10 closely fit outer surfaces of the second teeth portions 31 and the second groove portions 32, respectively.

Preferably, in order to enhance the effect of making the non-woven fabric 10 closely fit the outer surfaces of the second teeth portions 31 and the second groove portions 32 of the suction gears 30, the suction holes 33 may be further disposed on the second teeth portions 31.

Subsequently, the hollow groove 34 of the suction gears 30 is configured to allowed the pins 41 of the pin chains 40 to puncture the fed non-woven fabric 10 and enter the hollow groove 34 when the pin chains 40 run in the form of conveyor belt while the suction gears 30 rotate, for fixing the wavy folds of the fed non-woven fabric 10.

Moreover, the suction gears 30 stop providing the suction force after the pins 41 puncture the fed non-woven fabric 10, such that the non-woven fabric 10 can be smoothly transferred from the suction gears 30 to the pin chains 40.

Then, the brush wheel 50 rotates while the pin chains 40 run in the form of conveyor belt, so as to press-flatten the wavy folds of the non-woven fabric 10 on the pin chains 40. In order to process smoothly, the brush wheel 50 is configured to has a height that allows the wavy folds of the non-woven fabric 10 fixed on the pin chains 40 to be press-flattened when the brush wheel rotates above the pin chains 40.

In addition, in order to press-flatten the wavy folds of the non-woven fabric 10 before stretching and broadening (to be described later) the non-woven fabric 10, the brush wheel 50 can be specifically arranged within the range from downstream in the warp direction of the feeding wheel sets F to the softening section 62*a* of the heating device 60.

In the prior art, since the fabric will shrink after being dyed with high-temperature water, a setting machine will be used to broaden the fabric during the high-temperature drying process to compensate the shrinkage and to set the fabric, so as to make the width of the fabric consistent, and to stabilize the straight arrangement of the warp and weft yarns, and also to adjust the feel of the fabric; in addition, the arrangement of the warp and weft yarns can be more finely adjusted during broadening by using the overfeeding technology.

The above prior art is applied to the fabrics with the arrangement of warp and weft yarns; and in the broadening and setting process of the fabrics using the overfeeding technology, the factors such as the denier value (tensile strength), the arrangement of warp and weft yarns (tensile strength of tissue arrangement) and the thread count (tensile strength of density) of the fabrics and their adjustable ranges have been fixed and cannot be adjusted by a larger extent.

During the development of the present invention, when the setting machine and overfeeding technology in the above prior art are applied to the non-woven fabrics, it is found that: unlike fabrics with the arrangement of warp and weft yarns, the fibers of the non-woven fabrics have disoriented arrangement, in which the effect of broadening and setting, as well as necking by overfeeding can be increased. However, the overfeeding technology applied in the above prior art will affect the uniformity of the non-woven fabrics due to lacking the design of gears and suction devices (as shown in FIG. 9A).

In the present invention, through the improved design of the differential gears 20 and the suction gears 30, regular wavy folds can be formed on the non-woven fabric 10 and then transferred to the pin chains with maintained shape, which avoids the problem of uneven wavy folds caused by fabric overfeeding simply based on speed difference, and a problem of uneven thickness of the final fabric after broadening in the weft direction in the broadening and setting process of the prior art.

Figure 5A:
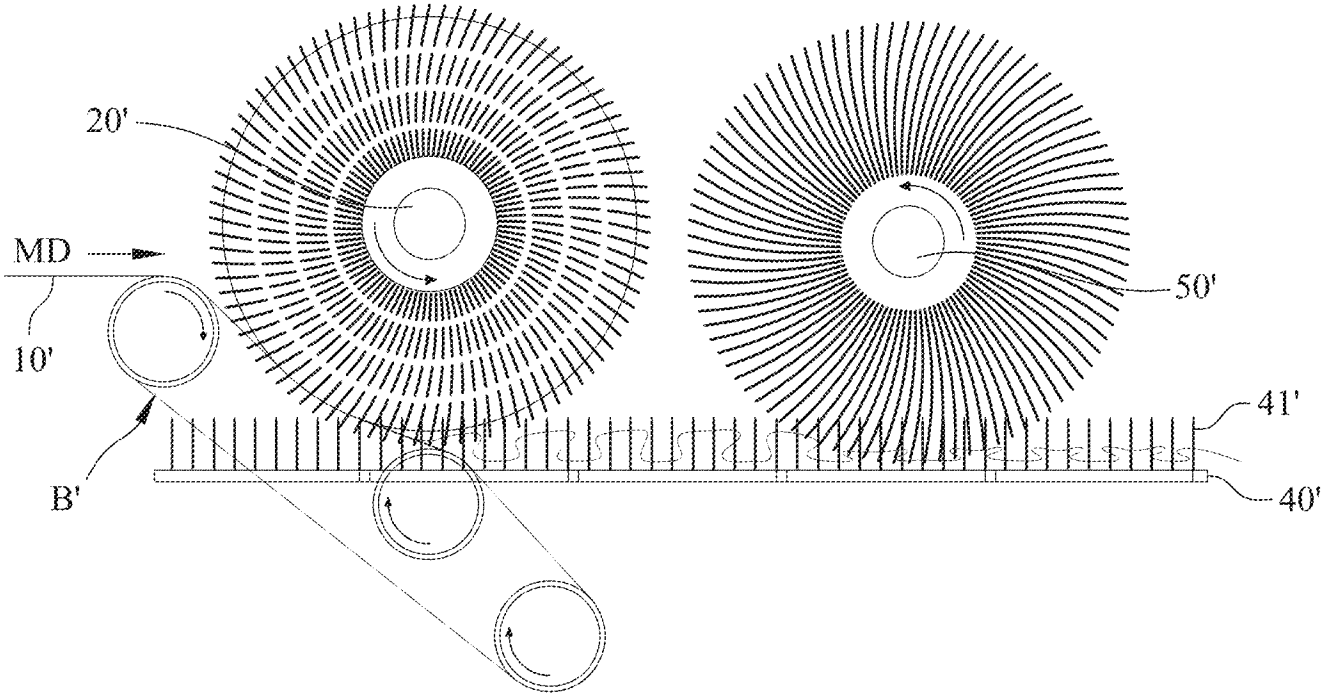
FIG. 5A (PRIOR ART)
FIG. 5A shows a schematic diagram of wavy folds, which are formed only by a differential wheel with a flat surface, being press-flattened by a brush wheel in a setting machine in the prior art.
Figure 5B:
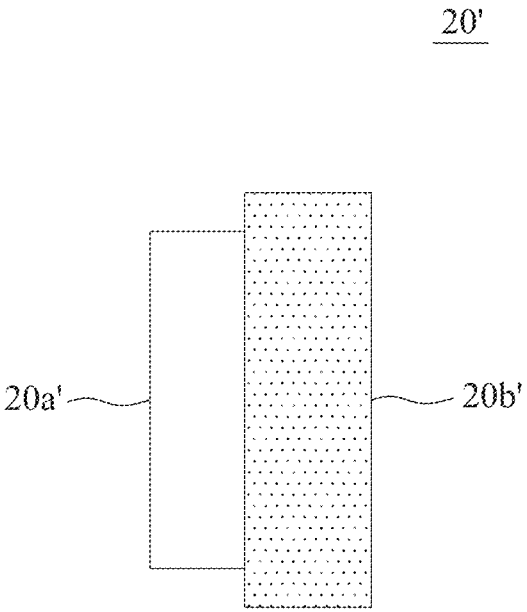
FIG. 5B (PRIOR ART)
FIG. 5B shows the differential wheel of the setting machine in the prior art.

As shown in FIGS. 5A to 5B, in the fabric setting machine of the prior art, there is only a configuration of a differential wheel 20' and a brush wheel 50', without the suction gear. Wherein, a belt wheel B' and the differential wheel 20' overfeed the non-woven fabric 10' into a location between the differential wheel 20' and the brush wheel 50', thereby generating an overfeeding difference based on a feeding speed of belt wheel B' and the differential wheel 20' being greater than a conveying speed of pin chains 40', using the belt wheel B' and the differential wheel 20' to clamp the non-woven fabric 10' to cause squeezing by speed difference, so as to form wavy folds, and then using the brush wheel 50' to press the non-woven fabric 10' into the pin chains 40'.

Preferably, as shown in FIG. 5B, the differential wheel 20' has a friction surface 20*a*' at one side of the circumferential surface thereof, and a brush 20*b*' at the other side, and the brush 20*b*' on the differential wheel 20' can also used to press the non-woven fabric 10' into the pin chains 40'.

However, since the differential wheel 20' of the prior art has a flat surface without teeth portion, it can only provide friction between it and the non-woven fabric 10' through a friction surface thereof (for example, made of rubber material).

Figure 6A:
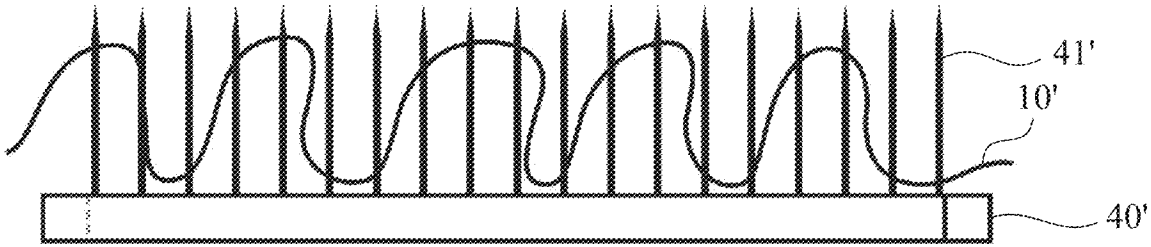
FIG. 6A (PRIOR ART)
FIG. 6A shows a schematic diagram of the uneven wavy folds formed by the setting machine in the prior art.
Figure 6B:
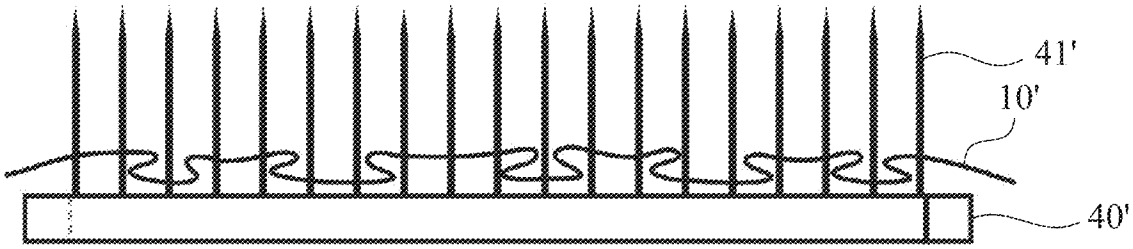
FIG. 6B (PRIOR ART)
FIG. 6B shows a schematic diagram of the uneven wavy folds formed by the setting machine in the prior art after being press-flattened by the brush wheel.

Therefore, this configuration will cause uneven wavy folds of the non-woven fabric, which will lead to a problem of uneven fabric surface after broadening in the weft direction. Specifically, while the differential wheel 20' rotates, the pins 41' on the pin chains 40' puncture and fix the uneven wavy folds of the non-woven fabric 10' (as shown in FIG. 6A), and after the brush wheel 50' further press-flattens the wavy folds, only the non-woven fabric 10' having uneven wavy folds being press-flattened can be obtained (as shown in FIG. 6B). Therefore, uniform broadening cannot be achieved in the subsequent process, thereby leading to a problem of unevenness in the final fabric surface.

Figure 7:
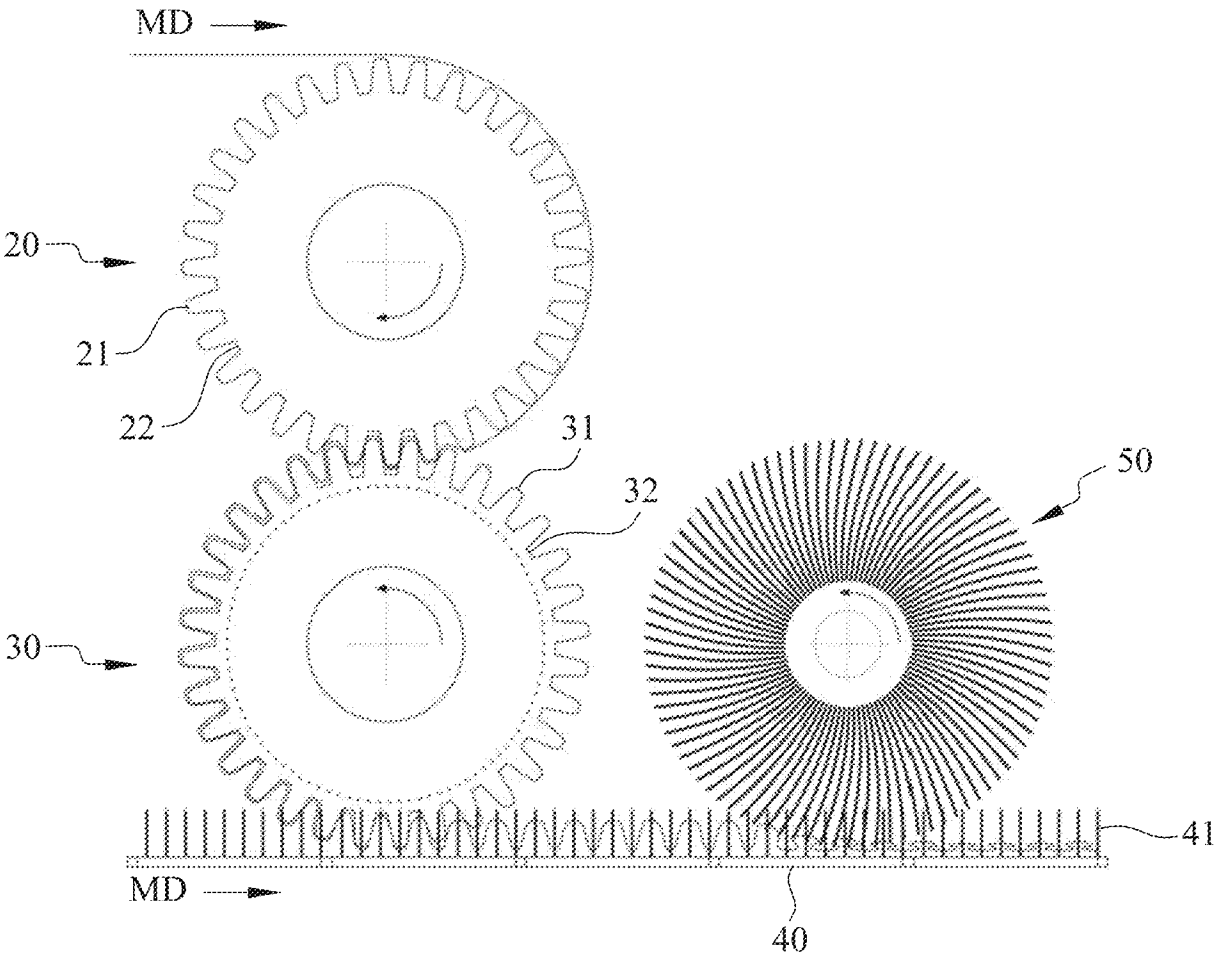
FIG. 7 shows a schematic diagram of the wavy folds, which are formed by feeding wheel sets including differential gears and suction gears in forms of gear, being press-flattened by a brush wheel in the manufacturing equipment of the present invention.
Figure 8A:
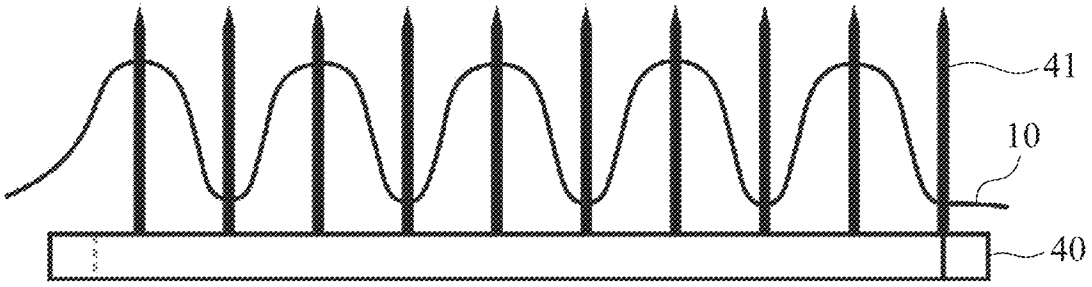
FIG. 8A shows a schematic diagram of the uniform wavy folds formed by the manufacturing equipment of the present invention.
Figure 8B:
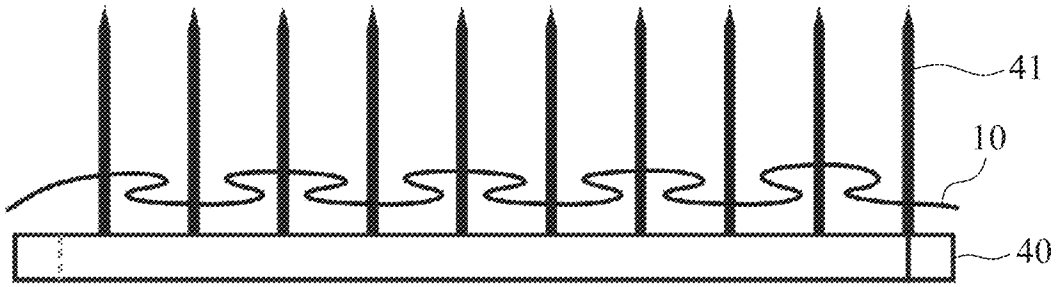
FIG. 8B shows a schematic diagram of the uniform wavy folds formed by the manufacturing equipment of the present invention after being press-flattened by the brush wheel.

Referring to FIGS. 7 to 8B, the manufacturing equipment of the present invention is different from the prior art in that: in the present invention, the flat differential wheel 20' of the prior art is replaced by the differential gear 20 in form of gear, and the suction gear 30 is further provided.

As the differential gears 20 and the suction gears 30 mesh with each other and rotate, the non-woven fabric 10 will enter a location between teeth portions and groove portions of the differential gears 20 and the suction gears 30, thereby forming regular wavy folds on the non-woven fabric 10 along the warp direction.

Thereafter, since the suction holes 33 are disposed on the surface of the suction gears 30, by providing a suction force through the suction holes 33 to make the non-woven fabric 10 closely fit outer surfaces of the second teeth portions 31 and the second groove portions 32 of the suction gears 30, thereby temporarily fixing the wavy folds of the non-woven fabric 10 through suction force, the wavy folds of the non-woven fabric 10 can be transferred to the subsequent process with maintained shape, which facilitates the subsequent fixing through the pin chains 40, so as to avoid the non-woven fabric 10 from shifting during the subsequent process, thereby improving the uniformity of the final non-woven fabric surface.

After that, as the suction gears 30 rotate, the non-woven fabric 10 having wavy folds move to the upper location the pin chains 40, and as the pin chains 40 run in the form of conveyor belt, the pins 41 on the pin chains 40 puncture and fix the regular wavy folds of the non-woven fabric 10 (as shown in FIG. 8A); subsequently, after the brush wheel 50 further press-flattens the wavy folds, the non-woven fabric 10 having regular wavy folds being press-flattened can be obtained (as shown in FIG. 8B). Therefore, uniform broadening can be achieved in the subsequent process, thereby an elastic non-woven fabric with elasticity in warp direction having an uniform fabric surface can be manufactured.

Figure 9B:
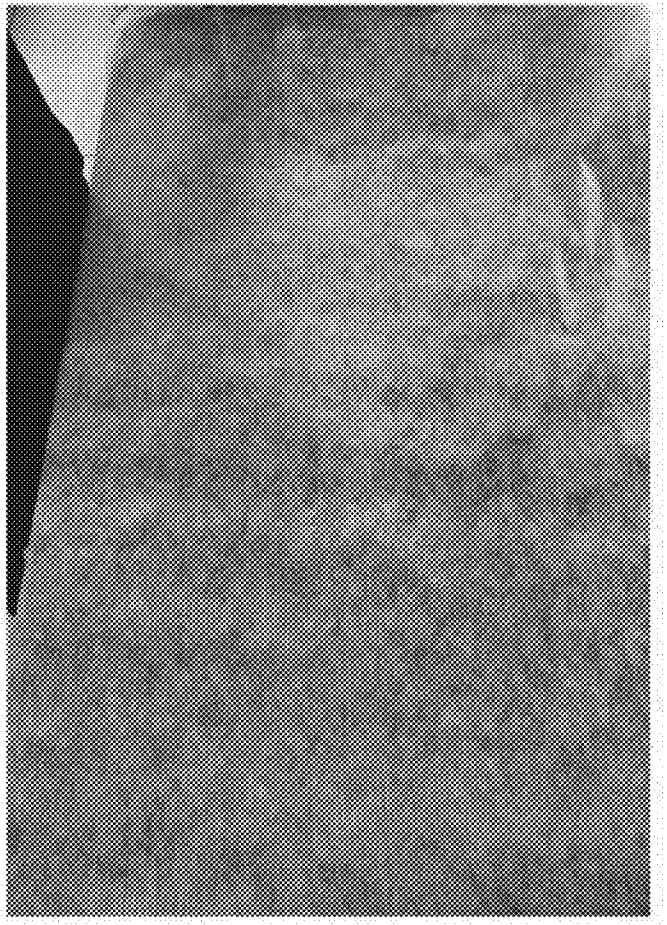
FIG. 9B shows a photo of a final elastic non-woven fabric manufactured by the manufacturing equipment of the present invention.
Figure 9A:
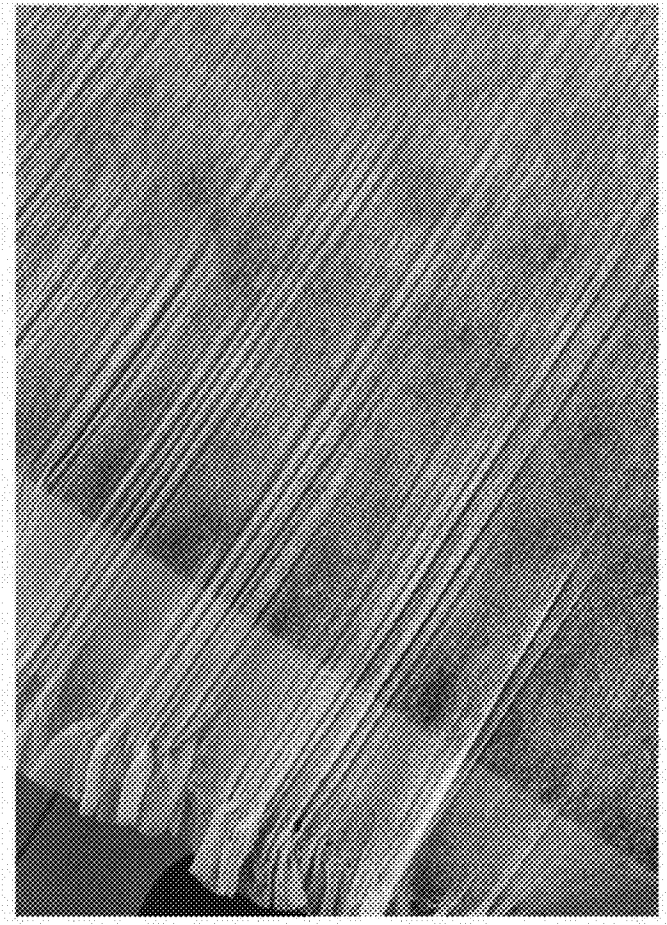
FIG. 9A (PRIOR ART)
FIG. 9A shows a photo of a final fabric manufactured by the setting machine in the prior art.

FIG. 9A and FIG. 9B show photos of the final fabric manufactured by the manufacturing equipment of the prior art and the final non-woven fabric manufactured by the manufacturing equipment of the present invention, respectively. Wherein, when the differential wheel 20' of the prior art is used, the final fabric has uneven folds, and when the differential gears 20 and the suction gears 30 of the present invention are used, the final non-woven fabric has flat surface appearance.

Preferably, the spacing or arranging density between the pins 41 of the pin chains 40 can be adjusted to increase the degree of fixing of the pin chains 40 to the non-woven fabric 10.

Preferably, multiple sets of pin chains 40 can be provided, and the number of teeth portions and the distance between pin chains can be adjusted depending on demand in elastic extension.

Preferably, the differential gears 20 and the suction gears 30 can be designed to have same diameter and same number of teeth portions, thus a rotating speed ratio of the differential gears 20 to the suction gears 30 can be 1:1.

Preferably, compared with the manufacturing equipment of the elastic non-woven fabric with elasticity in warp direction of the prior art, the number of teeth portions of the differential gears 20 and the suction gears 30 can be increased or decreased and replaced by modules, and the number and height of the teeth portions and the groove portions can also designed correspondingly to the pin chains 40.

Preferably, the manufacturing equipment of the present invention can be designed such that respective pins 41 are respectively aligned with a peak and/or a trough of the wavy folds of the non-woven fabric 10 (as shown in FIG. 8A), therefore, the wavy folds can be better fixed in subsequent processes.

Preferably, a ratio of a spacing between the first teeth portions 21, a spacing between the second teeth portions 31, and a spacing between the pins 41 can be designed to be 1:1:1, such that respective pins 41 can be respectively aligned with each peak or trough of the wavy folds of the non-woven fabric 10.

Alternatively, in a more preferred embodiment, a ratio of a spacing between the first teeth portions 21, a spacing between the second teeth portions 31, and a spacing between the pins 41 can be designed to be 1:1:0.5, such that respective pins 41 can be respectively aligned with each peak and trough of the wavy folds of the non-woven fabric 10 (as shown in FIG. 8A).

Preferably, in the manufacturing equipment of the present invention, by adjusting the height and width of the first teeth portions 21 and the second teeth portions 31, the width of the first groove portions 22 and the second groove portions 32, and the distance between the differential gears 20 and the suction gears 30, the height or width of the wavy folds of the non-woven fabric 10 can be adjusted, that is, the shape of the wavy folds of the non-woven fabric 10 can be changed.

The thickness, elasticity in warp direction and uniformity of the final elastic non-woven fabric with elasticity in warp direction can be adjusted by changing the shape of the wavy folds of the non-woven fabric.

There is an corresponding relationship between the height or width of the wavy folds, the distance between the two types of wheels, and the uniformity of the fabric, for example, when the number of gears and the distance of the gears are fixed, if the broadening amount in the weft direction is large, the distance between the two types of wheels will be short (the height of the wavy folds is large), there are enough amount of fibers to be stretched toward both sides, the fabric is slightly thicker, the necking amount is large, and the elasticity in the warp direction is good; if the broadening amount in the weft direction is small, the distance between the two types of wheels is long (the height of the wavy folds is small, the necking amount is small, and the elasticity in the warp direction is poor. The elasticity in the warp direction can be controlled and adjusted according to needs, and the weight of the fabric can be maintained uniform.

On the other hand, if the broadening amount in the weft direction is large, the distance between the two types of wheels will be long (the height of the wavy folds is small), the necking amount is large, and the amount of fibers is insufficient due to the less number of folds, there will be a problem of uneven surface and uneven weight of the fabric; if the broadening amount in the weft direction is small, the distance between the two types of wheels will be short (the height of the wavy folds is large), the fabric will become thicker and has reduced elasticity.

Specifically, under the same broadening ratio, the height and uniformity of the wavy folds will affect the flatness of the fabric (i.e., causing uneven weight per unit area of the fabric), and in the process of broadening in the weft direction, stretching, and necking under appropriate temperatures, the fibers with wavy folds having large height and even arrangement are easier to be expanded evenly; however, when the height of the wavy folds is small and the wavy folds are unevenly arranged, the fibers at thinner portions of the fabric will be stretched first and unevenly, such that the thickness of the fabric becomes thinner, moreover, when the wavy folds are arranged densely in some portions and loosely in the other portions, uneven continuously necking in the warp direction will occurred.

The present invention is advantageous compared with the prior art in that: the height and arrangement uniformity of the wavy folds can be adjusted; a stable continuously necking in the warp direction of the non-woven fabric can be generated through precisely control of the process conditions, such that a continuous shrinkage ratio in the warp direction of each portion of the fabric can be consistent (continuous elasticity); and controlling the elastic stretching and restoring effect of the non-woven fabric and achieving uniform weight per unit area of the fabric.

Subsequently, the pin chains 40 transports the non-woven fabric 10 with the press-flattened wavy folds to the internal space 62 of the heating device 60 along the warp direction from the inlet 61 of the heating device 60.

After that, in the preheating section 62*a* of the heating device 60, under the condition that the pin chains 40 respectively fixing both sides of the non-woven fabric 10 maintain at a fixed distance in the weft direction, that is, without changing the width of the non-woven fabric 10, the pin chains 40 transport the non-woven fabric 10 into the broadening section 62*b* along the warp direction; at the same time, the heating device 60 heats the non-woven fabric 10 to soften it for subsequent processing and shaping.

Subsequently, in the broadening section 62*b* of the heating device 60, the heating device 60 proceeds to heat the non-woven fabric 10 to maintain it at the softening temperature; while under the condition that the distance in the weft direction of the pin chains 40 respectively fixing both sides of the weft direction of the non-woven fabric 10 gradually increase, the pin chains 40 proceed to transport the softened non-woven fabric 10 along the warp direction, so as to stretch the non-woven fabric 10 along the weft direction by the gradually increased distance in the weft direction of the pin chains 40, thereby increasing the width in the weft direction of the non-woven fabric 10.

Preferably, a broadening ratio of the non-woven fabric 10 in the weft direction in the broadening section 62*b* can be, for example, between 15 and 100% (that is, the non-woven fabric 10 is finally stretched to a width in the weft direction 1.15 to 2 times of its original width in the weft direction in the broadening section 62*b*).

For example, the width in the weft direction of the non-woven fabric is 100 cm, after broadening in the weft direction and stretching, the width in the weft direction becomes 115 cm, thus the broadening ratio in the weft direction is 115%. For another example, the width in the weft direction of the non-woven fabric is 100 cm, after broadening in the weft direction and stretching, the width in the weft direction becomes 200 cm, thus the broadening ratio in the weft direction is 200%.

In addition, a broadening ratio in the weft direction of commercially available setting machines can be up to 450%, for example.

During the stretching in the weft direction, the fibers of the non-woven fabric 10 are mechanically continuously stretched in the weft direction by the spacing gradually increased in the weft direction of the pin chains 40, which changes the orientation of the fiber tissue, thereby making the fiber tissue of the non-woven fabric 10 be oriented along the weft direction, so as to impart the non-woven fabric 10 a stretching and restoring ability along the warp direction; at the same time, due to the stretching in the weft direction, a necking compensation effect of the non-woven fabric 10 occurs along the warp direction due to the Poisson's ratio, thereby straightening the wavy folds that extend along the warp direction and are press-flattened, such that the fabric is in a flat shape.

Next, in the stabilizing section 62*c* of the heating device 60, the heating device 60 proceeds to heat the non-woven fabric 10 to maintain it at the softening temperature; while under the condition that the pin chains 40 respectively fixing both sides of the weft direction of the non-woven fabric 10 maintain at the increased distance in the weft direction, that is, the non-woven fabric 10 maintains at the broadened width, the pin chains 40 transport the softened and stretched non-woven fabric 10 along the warp direction, such that the non-woven fabric 10 is kept in a softened and broadened state for a period of time, thereby stabilizing the stretched and broadened non-woven fabric 10.

Finally, the pin chains 40 fixing both sides of the weft direction of the non-woven fabric 10 transport the stabilized non-woven fabric 10 out of the heating device 60 from the outlet 63, thereby cooling the stabilized non-woven fabric to set it, that is, to set it in a state of being stretched, broadened, and having elasticity in the warp direction, thereby forming the elastic non-woven fabric with elasticity in warp direction of the present invention.

Figure 1B:
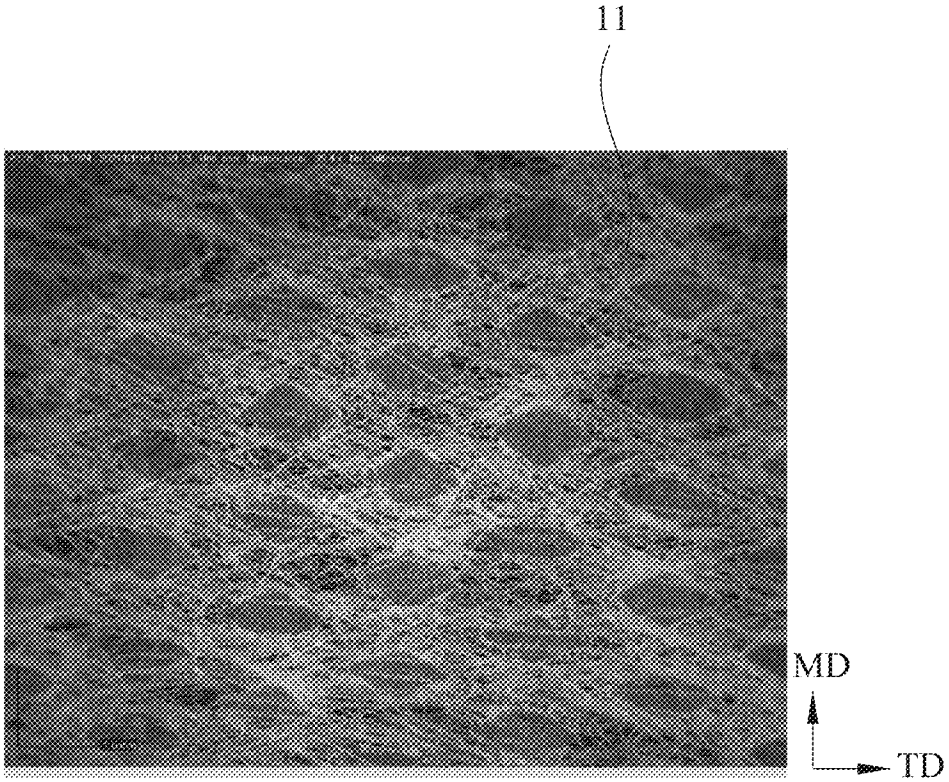
FIG. 1B (PRIOR ART)
FIG. 1A and FIG. 1B respectively show images of general spunbond non-woven fabrics before and after being stretched in the weft direction (photographed by a hand-held low-noise and high-definition digital microscope)
Figure 1A:
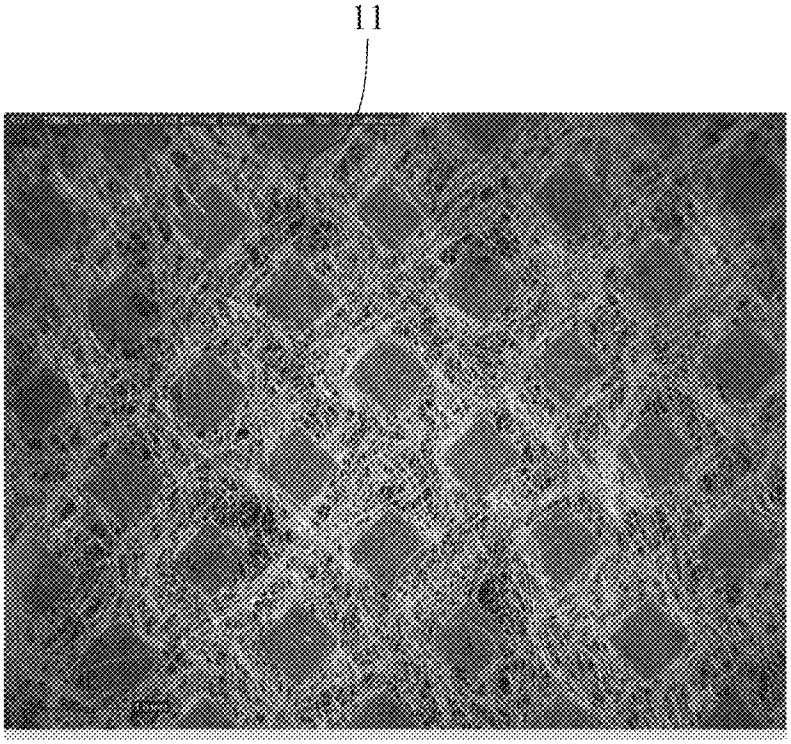
FIG. 1A (PRIOR ART)
Figure 2B:
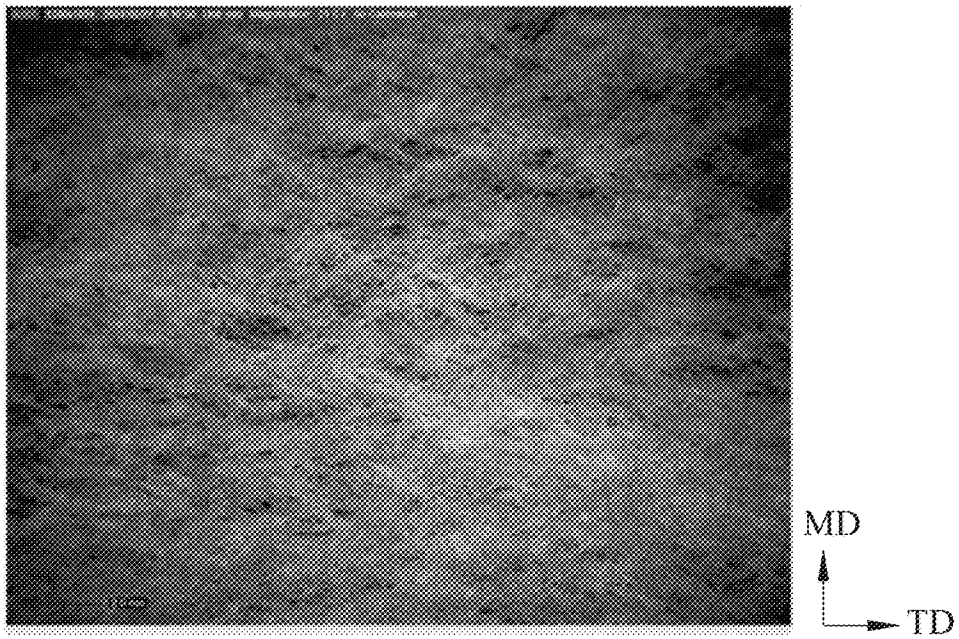
FIG. 2B (PRIOR ART)
FIG. 2A and FIG. 2B respectively show images of general spunlace non-woven fabrics before and after being stretched in the weft direction (photographed by a hand-held low-noise and high-definition digital microscope)
Figure 2A:
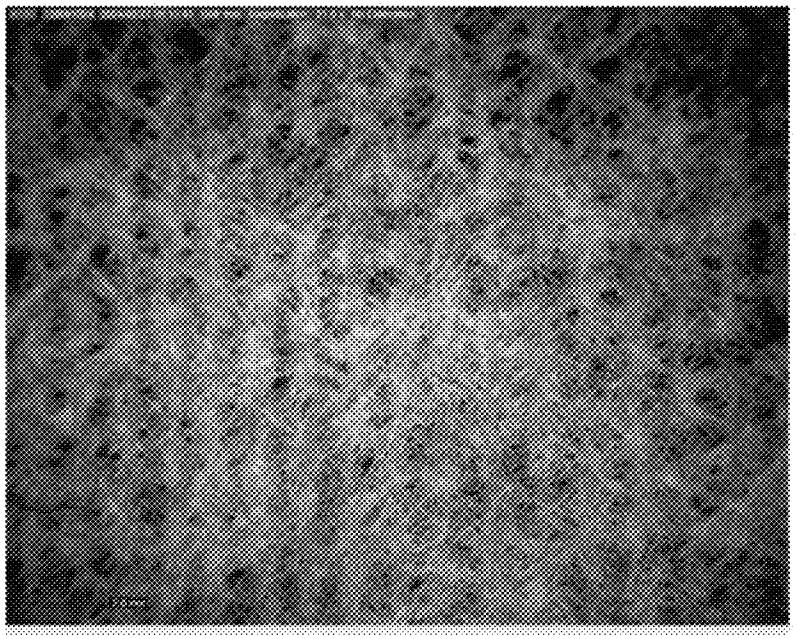
FIG. 2A (PRIOR ART)

After cooling and setting, the fiber tissue of the non-woven fabric 10 is oriented along the weft direction and forms a state of a telescopic robotic arm (as shown in FIG. 1B), when a stretching force in the warp direction is applied, the fiber tissue oriented in the weft direction of the non-woven fabric 10 can be stretched along the warp direction back to a state where the fiber orientation has not been altered, therefore, the non-woven fabric 10 has extensibility in the warp direction; moreover, after stopping applying the stretching force in the warp direction, the elastic non-woven fabric will restore to the state being oriented in the weft direction, therefore, the non-woven fabric 10 has a restoring ability in the warp direction. Therefore, the orientation in the weft direction formed by stretching and broadening along the weft direction imparts the elastic non-woven fabric with elasticity in warp direction of the present invention a high stretching and restoring characteristic that is superior to the elastic non-woven fabric of the prior art.

Figure 10:
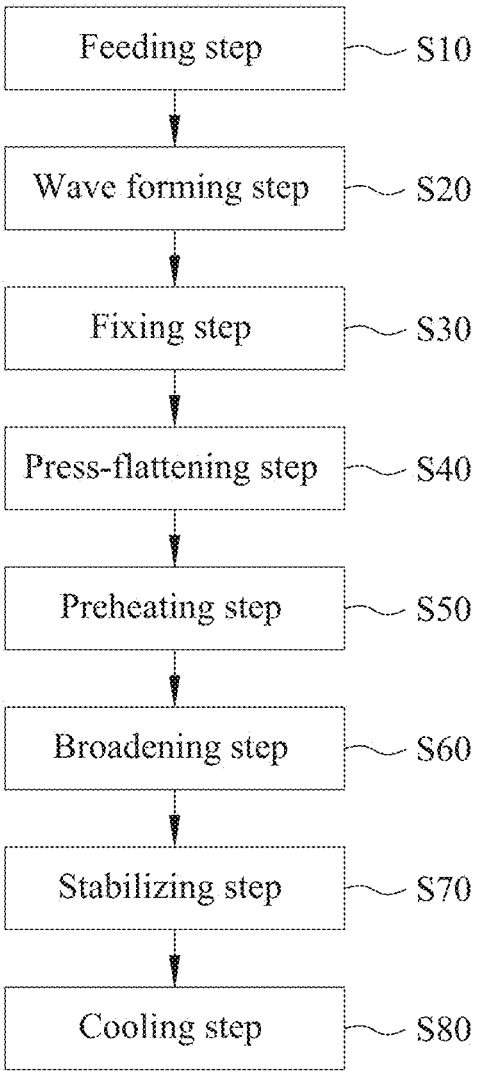
FIG. 10 shows a flow chart of a manufacturing method of the elastic non-woven fabric with elasticity in warp direction of the present invention.

Referring to FIG. 10, which shows a flow chart of a manufacturing method of an elastic non-woven fabric with elasticity in warp direction of the present invention. The manufacturing method of the elastic non-woven fabric of the present invention sequentially comprises: a feeding step S10, a wave forming step S20, a fixing step S30, a press-flattening step S40, a preheating step S50, a broadening step S60, a stabilizing step S70, and a cooling step S80.

The elements used in the following steps, such as the heating device, the pin chain, the feed wheel set and the brush wheel, can be the elements mentioned above, such as the heating device 60, the pin chain 40, the feed wheel set F and the brush wheel 50. Therefore, the features and details of these elements will not be described again.

In the feeding step S10, at least two feeding wheel sets are used to feed a non-woven fabric, wherein differential gears of the feeding wheel sets feed both sides in the weft direction of the non-woven fabric into a location between the differential gears and the suction gears of the feeding wheel sets respectively along a warp direction;

In the feeding step 10, the fed non-woven fabric may be the non-woven fabric 10 as described above, therefore, the features and details of the non-woven fabric will not be described again.

In the wave forming step S20, the differential gears and suction gears engage and rotate with each other in a manner that the first teeth portions of the differential gears are inserted into the second groove portions of the suction gears and the second teeth portions of the suction gears are inserted into the first groove portions of the differential gears, such that both sides in the weft direction of the non-woven fabric respectively enter a location between the first teeth portions and the second groove portions and a location between the first groove portions and the second teeth portions, thereby forming regular wavy folds on the non-woven fabric along the warp direction.

In the fixing step S30, the suction gears and at least two pin chains in a form of conveyor belt are used to fix the wavy folds of the non-woven fabric, wherein a suction force is provided through the suction holes of the suction gears to make both sides in the weft direction of the non-woven fabric closely fit outer surfaces of the second teeth portions and the second groove portions of the suction gears, respectively, and the pin chains run in the form of conveyor belt while the suction gears rotate, making the pins puncture the non-woven fabric and enter the hollow grooves of the suction gears, respectively, to fix the wavy folds of the non-woven fabric; moreover, the suction gears stop providing the suction force after the pins puncture the non-woven fabric, such that the non-woven fabric can be smoothly transferred from the suction gears to the pin chains.

In the press-flattening step S40, the wavy folds of the non-woven fabric are press-flattened through at least two brush wheels, wherein the brush wheel rotates while the pin chains run in the form of conveyor belt, so as to press-flatten the wavy folds of the non-woven fabric on the pin chains.

In the preheating step S50, the pin chains are used to transport the non-woven fabric along the warp direction with maintaining a fixed distance in the weft direction of the pin chains, meanwhile, a heating device is used to heat the non-woven fabric to soften it.

In the broadening step S60, under proceeding the heating of the heating device, the pin chains are used to transport the softened non-woven fabric along the warp direction with the distance in the weft direction of the pin chains gradually increased to stretch the non-woven fabric in the weft direction, due to the stretching in the weft direction, a necking compensation effect of the non-woven fabric occurs along the warp direction due to the Poisson's ratio, thereby straightening the wavy folds that extend along the warp direction and are press-flattened, thereby making a fiber tissue of the non-woven fabric be oriented along the weft direction, such that the non-woven fabric is in a flat shape and has a stretching and restoring ability along the warp direction.

In the stabilizing step S70, under proceeding the heating of the heating device, the pin chains are used to transport the softened and stretched non-woven fabric along the warp direction with maintaining the increased distance in the weft direction of the pin chains for stabilizing the non-woven fabric.

In the cooling step S80, the stabilized non-woven fabric is cooled and set, thereby forming the elastic non-woven fabric with elasticity in the warp direction.

In the manufacturing method of the elastic non-woven fabric with elasticity in warp direction of the present invention, in the feeding step S10, the differential gears feed the non-woven fabric into the location between the differential gears (also referred to as speed differential gears) and the suction gears along the warp direction at a speed higher than a conveying speed of the pin chains.

Preferably, the elastic non-woven fabric with elasticity in warp direction of the present invention manufactured by the above equipment or the above method has an elongation in the warp direction between 50 and 350% (that is, the elastic non-woven fabric can be stretched to a width in the warp direction 1.5 to 4.5 times of its natural width in the warp direction).

Preferably, in the above method, the suction holes are further provided on the second teeth portions.

Preferably, in the preheating step S50, the broadening step S60 and the stabilizing step S70, the heating of the heating device is performed at a heating temperature of 120 to 180° C., preferably 130 to 150° C.

Preferably, in the broadening step S60, a broadening ratio of the non-woven fabric 10 in the weft direction is between 15 and 100%.

Preferably, in the cooling step S80, the non-woven fabric 10 subjected to the stabilizing step S70 is cooled, for example, by air cooling or resting at room temperature, such that the non-woven fabric 10 returns to an unsoftened state, thereby fixing the shape of the non-woven fabric 10.

Preferably, in the fixing step S30, respective pins on the pin chains are aligned with a peak and/or a trough of the wavy folds of the non-woven fabric, respectively.

Preferably, in the above method, a ratio of a spacing between the first teeth portions, a spacing between the second teeth portions, and a spacing between the pins can be adjusted to 1:1:1 or 1:1:0.5.

Figure 11:
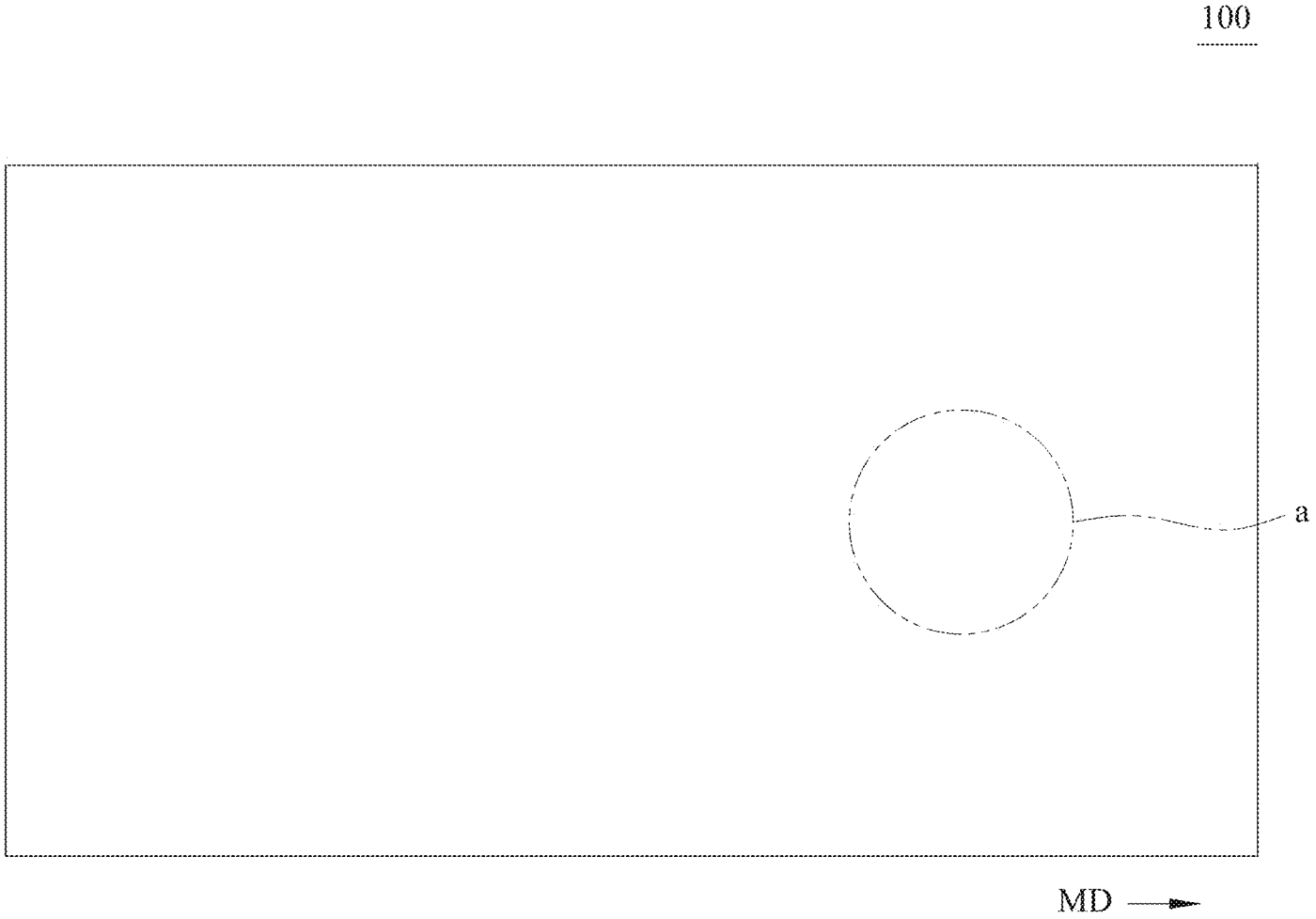
FIG. 11 shows a schematic diagram of an appearance of the elastic non-woven fabric with elasticity in warp direction of the present invention.
Figure 12:
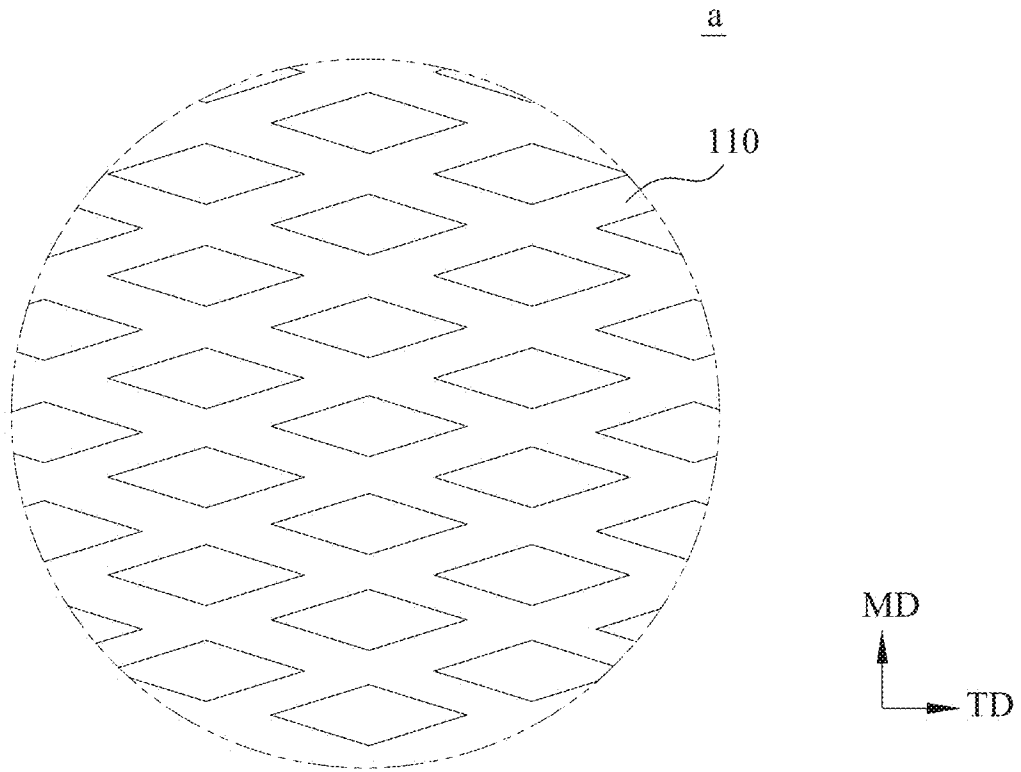
FIG. 12 shows a partial enlarged view of a region a of FIG. 11.

Referring to FIGS. 11 and 12, the present invention provides an elastic non-woven fabric 100 with elasticity in warp direction, which can be manufactured by the above-mentioned manufacturing equipment or manufacturing method, and has the above-mentioned characteristics and technical effects.

Specifically, referring to FIG. 11, the elastic non-woven fabric 100 with elasticity in warp direction of the present invention has a flat surface. Further, referring to FIG. 12, which shoes a partial enlarged view of a region a of FIG. 11, in which a fiber tissue 110 of the elastic non-woven fabric 100 with elasticity in warp direction is substantially oriented in the weft direction.

When being stretched by an external force in the warp direction, since the fiber tissue 110 oriented in the weft direction of the elastic non-woven fabric 100 can be stretched along the warp direction back to a state where the fiber orientation has not been altered, after the external force is stopped, the fiber tissue 110 of the elastic non-woven fabric 100 will return to the state oriented along the weft direction, thereby the elastic non-woven fabric 100 have the characteristics of high stretching and restoring characteristics in the warp direction that is superior to the elastic non-woven fabric of the prior art, that is, having high stretching and restoring ability.

In summary, the effects of the present invention are that: first, by feeding the non-woven fabric through the differential gears and the suction gears that engage with each other, regular wavy folds can be formed on the non-woven fabric, which is beneficial to ensure the surface flatness of the final elastic non-woven fabric; second, by providing a suction force through the suction gears to make the non-woven fabric closely fit outer surfaces of the teeth portions and groove portions of the suction gears, the non-woven fabric with the wavy folds can be transferred to the subsequent process with maintained shape, which is beneficial to improve the uniformity of the final fabric; third, by disposing a hollow groove at a center on the outer surfaces of the suction gears, a space for accommodating the pins on the pin chains after the pins puncture the non-woven fabric can be provided; fourth, by slightly stretching in the weft direction under heating to change the fiber orientation and subsequent cooling and setting, the non-woven fabric can have better elasticity in the warp direction than the prior art; fifth, by pre-forming regular wavy folds, the reduced area or reduced thickness of the non-woven fabric caused by necking during subsequent stretching can be compensated; sixth, by making the single-layered non-woven fabric have excellent elasticity after processing, additional bonding materials or bonding steps can be omitted, thereby reducing the manufacturing costs and making the product thinner to improve comfort to user, and reducing the space and cost required for storage and transportation.

A person skilled in the art will understand that various modifications and changes can be made to the above embodiments, such as combinations, separations, substitutions, and changing configuration, without departing from the basic features of the present invention.

Therefore, the embodiments of the present invention are intended to illustrate the scope of the technical concept of the present invention, but the scope of the present invention is not limited by the above embodiments. Therefore, any modifications or changes to the present invention made under the same creative spirit should still be included in the scope to be protected of the present invention.

What is claimed is:

1. A manufacturing method of an elastic non-woven fabric with elasticity in warp direction, sequentially comprising:

a feeding step, using at least two feeding wheel sets to feed a non-woven fabric, wherein the feeding wheel sets are respectively located at both sides in a weft direction of the non-woven fabric, and each feeding wheel set includes a differential gear and a suction gear that engage with each other, wherein each differential gear is provided with a plurality of first teeth portions and a plurality of first groove portions alternately arranged along an outer circumferential surface of the differential gear, and each suction gear is provided with a hollow groove at a center in the weft direction on an outer surface thereof, and each suction gear is provided with a plurality of second teeth portions, a plurality of second groove portions and a plurality of suction holes at both sides in the weft direction of the hollow groove, respectively, wherein the second groove portions and the second teeth portions are alternately arranged along both sides in the weft direction of an outer circumferential surface of the suction gears, respectively, and the suction holes are provided at least on the second groove portions, wherein the differential gears feed both sides in the weft direction of the non-woven fabric into a location between the differential gears and the suction gears respectively along a warp direction;

a wave forming step, rotating the differential gears and the suction gears with engaging with each other in a manner that the first teeth portions are inserted into the second groove portions and the second teeth portions are inserted into the first groove portions, such that both sides in the weft direction of the non-woven fabric respectively enter a location between the first teeth portions and the second groove portions and a location between the first groove portions and the second teeth portions, thereby forming regular wavy folds on the non-woven fabric along the warp direction;

a fixing step, using the suction gears and at least two pin chains in a form of conveyor belt to fix the wavy folds of the non-woven fabric, wherein the pin chains are respectively located on both sides in the weft direction of the non-woven fabric, and the feeding wheel sets are respectively arranged above the pin chains, and a plurality of pins are provided on each pin chain, wherein a suction force is provided through the suction holes to make both sides in the weft direction of the non-woven fabric closely fit outer surfaces of the second teeth portions and the second groove portions, respectively, and the pin chains run in the form of conveyor belt while the suction gears rotate, making the pins puncture the non-woven fabric and enter the hollow grooves, respectively, to fix the wavy folds of the non-woven fabric, and the suction gears stop providing the suction force after the pins puncture the non-woven fabric, such that the non-woven fabric can be smoothly transferred from the suction gears to the pin chains;

a press-flattening step, press-flattening the wavy folds of the non-woven fabric through at least two brush wheels, wherein the brush wheels are respectively disposed above the pin chains at downstream in the warp direction of the feeding wheel sets, and the brush wheels rotate while the pin chains run in the form of conveyor belt, so as to press-flatten the wavy folds of the non-woven fabric on the pin chains;

a preheating step, using the pin chains to transport the non-woven fabric along the warp direction with maintaining a fixed distance in the weft direction of the pin chains, meanwhile, using a heating device to heat the non-woven fabric to soften it;

a broadening step, under proceeding the heating of the heating device, using the pin chains to transport the non-woven fabric along the warp direction with the distance in the weft direction of the pin chains gradually increased to stretch the non-woven fabric in the weft direction, such that a necking compensation effect of the non-woven fabric occurs along the warp direction to straighten the wavy folds that extend along the warp direction and are press-flattened, thereby making a fiber tissue of the non-woven fabric be oriented along the weft direction, such that the non-woven fabric is in a flat shape and has a stretching and restoring ability along the warp direction;

a stabilizing step, under proceeding the heating of the heating device, using the pin chains to transport the non-woven fabric along the warp direction with maintaining the increased distance in the weft direction for stabilizing the non-woven fabric; and a cooling step, cooling the non-woven fabric to set it, thereby forming the elastic non-woven fabric with elasticity in the warp direction;

wherein in the feeding step, the differential gears feed the non-woven fabric into the location between the differential gears and the suction gears along the warp direction at a speed higher than a conveying speed of the pin chains.

2. The manufacturing method according to claim 1, wherein the suction holes are further provided on the second teeth portions.

3. The manufacturing method according to claim 1, wherein in the preheating step, the broadening step and the stabilizing step, the heating is performed at a heating temperature of 120 to 180° C.

4. The manufacturing method according to claim 1, wherein in the broadening step, a broadening ratio of the non-woven fabric in the weft direction is between 15 and 100%.

5. The manufacturing method according to claim 1, wherein in the fixing step, respective pins on the pin chains are aligned with a peak and/or a trough of the wavy folds, respectively.

6. The manufacturing method according to claim 1, wherein a ratio of a spacing between the first teeth portions, a spacing between the second teeth portions, and a spacing between the pins is 1:1:1 or 1:1:0.5.

7. The manufacturing method according to claim 1, wherein the non-woven fabric is made by spun-bonding, spunlace, thermal-bonding, melt-blowing, or needle-punching.

8. The manufacturing method according to claim 1, wherein the non-woven fabric is made of a material selected from a group consisting of PP, PE, PET, PP/PE, PP/PET, or a combination thereof.

* * * * *